US006708781B2

(12) United States Patent
Ireland

(10) Patent No.: US 6,708,781 B2
(45) Date of Patent: Mar. 23, 2004

(54) SYSTEM AND METHOD FOR QUANTITATIVELY DETERMINING VARIATIONS OF A FORMATION CHARACTERISTIC AFTER AN EVENT

(75) Inventor: Peter J. Ireland, Austin, TX (US)

(73) Assignee: Schlumberger Technology Corporation, Austin, TX (US)

( * ) Notice: Subject to any disclaimer, the term of this patent is extended or adjusted under 35 U.S.C. 154(b) by 4 days.

(21) Appl. No.: 10/156,678

(22) Filed: May 28, 2002

(65) Prior Publication Data

US 2003/0221869 A1 Dec. 4, 2003

(51) Int. Cl.[7] ..... E21B 49/00

(52) U.S. Cl. ..... 175/40; 175/50

(58) Field of Search ..... 166/66, 250; 175/40, 175/45, 48, 50; 364/420

(56) References Cited

U.S. PATENT DOCUMENTS

| | | | | |
|---|---|---|---|---|
| 4,355,357 A | * | 10/1982 | Chan | 702/10 |
| 4,716,973 A | * | 1/1988 | Cobern | 175/50 |
| 4,833,914 A | * | 5/1989 | Rasmus | 73/152.03 |
| 4,845,628 A | * | 7/1989 | Gray et al. | 702/9 |
| 4,991,095 A | * | 2/1991 | Swanson | 702/16 |
| 5,130,949 A | | 7/1992 | Kan et al. | |
| 5,557,200 A | * | 9/1996 | Coates | 324/303 |
| 5,963,037 A | | 10/1999 | Brady et al. | |

FOREIGN PATENT DOCUMENTS

EP 0 718 641 A2 6/1996

OTHER PUBLICATIONS

International Search Report in PCT/US03/06991 dated Aug. 6,2003 (5 Pages).

Bratton, T. R. et al., "How to Diagnose Drilling Induced Fractures in Wells Drilled with Oil–Based Muds with Real-Time Resistivity and Pressure Measurements", SPE/IADC Drilling Conference, Amsterdam, The Netherlands, Feb. 27–Mar. 1, 2001, pp. 1–10.

Bratton, T. et al., "Logging–While–Drilling Images for Gromechanical, Geological, and Petrophysical Interpretations", Paper JJJ, SPWLA 40th Annual Logging Symposium, Oslo, Norway, 1999, pp. 1–14.

Chapter , Resistivity Logs, "Schlumberger Log Interpretation Principles/Applications", Schlumberger Wirleline & Testing, Sugar Land, Texas, 1989, 1991, pp. 7–1 to 7–40.

* cited by examiner

*Primary Examiner*—Frank Tsay
(74) *Attorney, Agent, or Firm*—Pebr Jansson; Brigitte L. Jeffery; John J. Ryberg

(57) ABSTRACT

A method for obtaining quantitative characteristics of an area of investigation includes measuring characteristics of the area of investigation in a first dimension, coordinating the measured characteristics with an index of a second dimension, the coordinating enabling an identification of a trend of the measured characteristics, and extrapolating using the trend in the second dimension to obtain quantitative characteristics of the area of investigation. An apparatus configured for use in a drill hole environment includes a clock configured to receive data from the depth meter and a processor configured to correlate clock data and depth data to provide a time after bit measure associated with a plurality of measurements of the measurements taken by the tool whereby the measurements taken at different depths are useful as compared to measurements taken independent of the time after bit measurements.

19 Claims, 10 Drawing Sheets

SYSTEM AND METHOD FOR QUANTITATIVELY DETERMINING VARIATIONS OF A FORMATION CHARACTERISTIC AFTER AN EVENT

BACKGROUND OF THE INVENTION

1. Field of the Invention

The present invention is related logging while drilling oil well equipment, and, more particularly, to a method and apparatus for quantitatively determining variations of a formation characteristic after an event.

2. Description of the Related Art

The exploration for subsurface minerals requires techniques for determining the characteristics of geological formations. Many characteristics, such as the hydrocarbon volume, resistivity, porosity, lithology, and permeability of a formation, may be deduced from certain measurable quantities. Thus, the techniques for determining the measurable quantities must be accurate. There are several reasons for requiring accuracy in the measurements. For example, the measurements assist in evaluating the economics of a potential oil reservoir, and in determining the appropriate techniques for drilling the well.

Although the accuracy of measurements is important, there are many impediments to achieving satisfactory accuracy. At least one such impediment is caused by drilling and the uncertainties caused thereby. Ideally, all characteristics of an earth formation are known prior to drilling. One such characteristic is referred to as the true resistivity (RT) of the formation. The actual RT is not a measurable quantity due to Heisenberg's uncertainty principle and the principle expounded by the Schrödinger's cat experiment, which both generally provide that an experiment does not have an outcome until the outcome is observed. Observing, then, alters any environment making completely accurate measurements impossible even for pristine environments. A drilling environment is far from pristine. For example, the drilling environment is exposed to drilling fluid, also known as mud, and the formation immediately alters due to contact with the mud. Changes caused by the mud include invasion changes due to the mud replacing fluid in the environment and absorption changes due to the environment absorbing the mud. The invasion changes alter any measurements, such as resistivity measurements of the affected environment. Changes to an environment may also be caused by other events, natural and man-made.

Furthermore, the changes caused by the mud are exacerbated partly because logging sensors are typically several feet behind the bit of a drilling string. Therefore, a length of time will pass between the bit cutting into a rock environment and the logging sensors measuring the rock environment. Prior art methods of determining original rock formations and environments fail to provide accurate information concerning the original, untouched environment. Because the reasons for drilling are to locate oil and gas reserves found in the virgin, undamaged environment, there is a need to determine as accurately as possible the original state of the environment and to identify changes caused by drilling that could be from the drilling and not related to the original state of the environment.

SUMMARY OF THE INVENTION

A method for obtaining quantitative characteristics of an area of investigation includes measuring characteristics of the area of investigation in a first dimension, coordinating the measured characteristics with an index of a second dimension, the coordinating enabling an identification of a trend of the measured characteristics, and extrapolating using the trend in the second dimension to obtain quantitative characteristics of the area of investigation.

In one embodiment, the first dimension is a depth dimension and the second dimension is a time dimension. Further, in one embodiment the first dimension is a depth dimension, the measuring being a measuring of a zone of interest, and the area of investigation is a well, the zone of interest being a depth zone. The method, in an embodiment, further includes choosing one or more measurement points within the area of investigation and plotting the one or more measurement points against the index of the second dimension to show changes of the characteristics of the area of investigation, the plotting providing quantifiable characteristics of the formation prior to the measuring.

One embodiment is directed to an apparatus configured for use in a drill hole environment. The apparatus includes a clock configured to receive data from the depth meter and a processor configured to correlate clock data and depth data to provide a time after bit measure associated with a plurality of measurements of the measurements taken by the tool whereby the measurements taken at different depths are useful as compared to measurements taken independent of the time after bit measurements.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Figure 1:
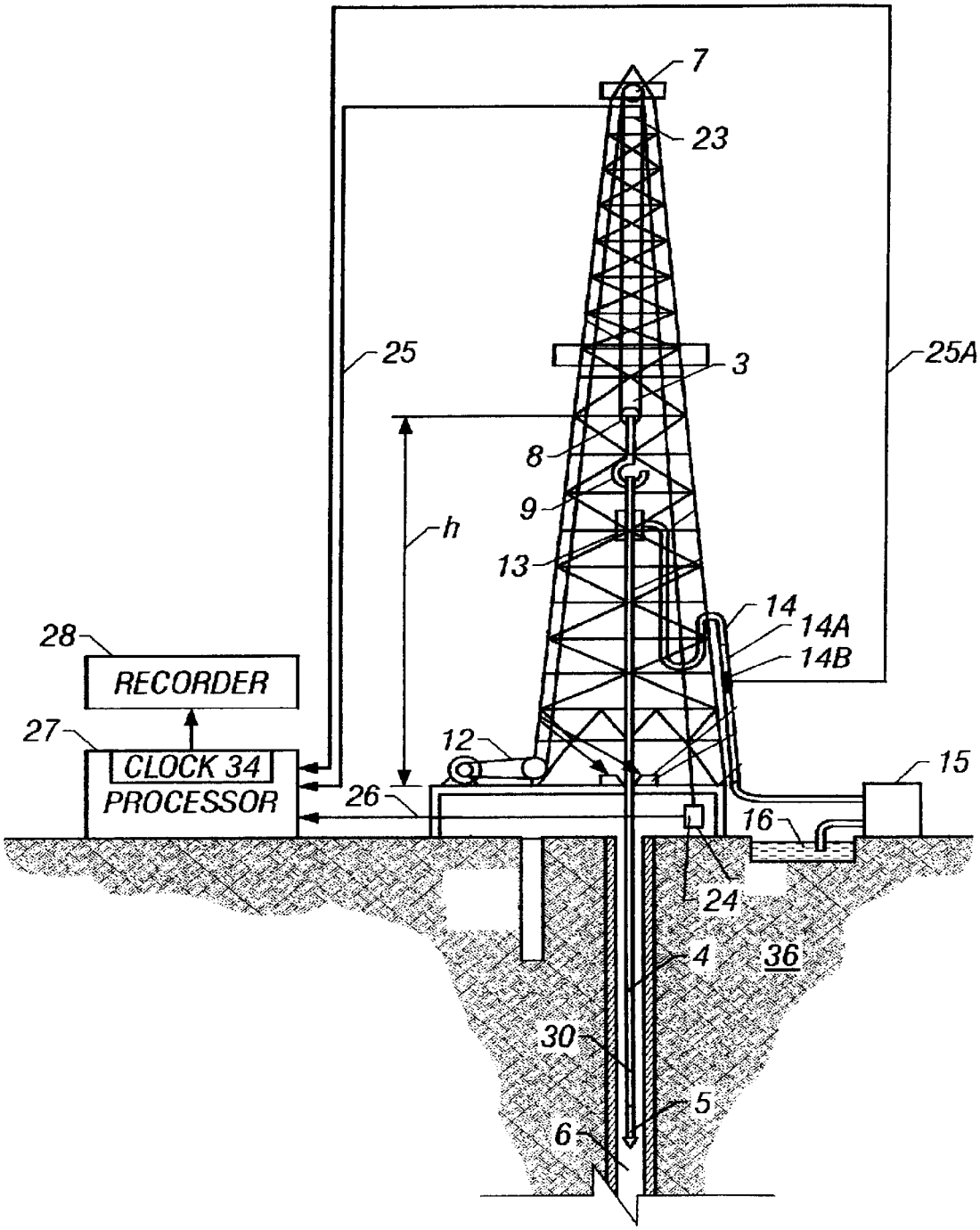
FIG. 1 illustrates a drilling rig and drill string in accordance with an embodiment of the present invention.

FIG. 1 illustrates a drilling rig and the drill string with a downhole logging tool for exploring drill hole environment 36.

Drill string 4 is suspended from hook 9 by means of swivel 13 linked by hose 14 to mud pump 15, which permits the injection of drilling mud into well 6, via the hollow pipes of drill string 4. Hose 14 is attached to standpipe 14A. Attached to standpipe 14A, one or more sensors 14B receive signals from within the well 6 via mud pulse telemetry. Mud pulse telemetry sensors 14B are coupled via signal line 25A to processor 27. Processor 27 incorporates a clock 34. Accordingly, sensors 14B function as measurement tools for delivering measurements to processor 27 and recorder 28. Processor 27 includes a clock 34 for providing a time measurement, as described in greater detail below. The drilling mud may be drawn from mud pit 16, which may be fed with surplus mud from well 6. The drill string may be elevated by turning lifting gear 3 with winch 12 and the drill pipes may be successively removed from (or added to) well 6 and unscrewed in order to remove bit 5.

The lowermost portion of the drill string 4 may contain one or more tools, as shown as tool 30 for investigating downhole drilling conditions or for investigating the properties of the geological formations penetrated by the bit 5 and borehole 6. Tool 30 is a logging tool capable of logging one or more different types of measurements and includes at least one measurement sensor. Tool 30 may be equipped for logging measurements of resistivity, gamma ray, density, neutron porosities, calipers and photoelectric effect as may be desired. Further, tool 30 may be equipped to include sensors for drilling-related measurements such as direction, depth, inclination and include equipment for data recording and telemetry.

Variations in height h of traveling block 8 during drill string raising operations are measured by means of sensor 23, which may be an angle of rotation sensor coupled to the faster pulley of crown block 7. Sensor 23 and strain gauge 24 are connected by signal lines 25 and 26 to a processor 27 which processes the measurement signals.

Figure 2:
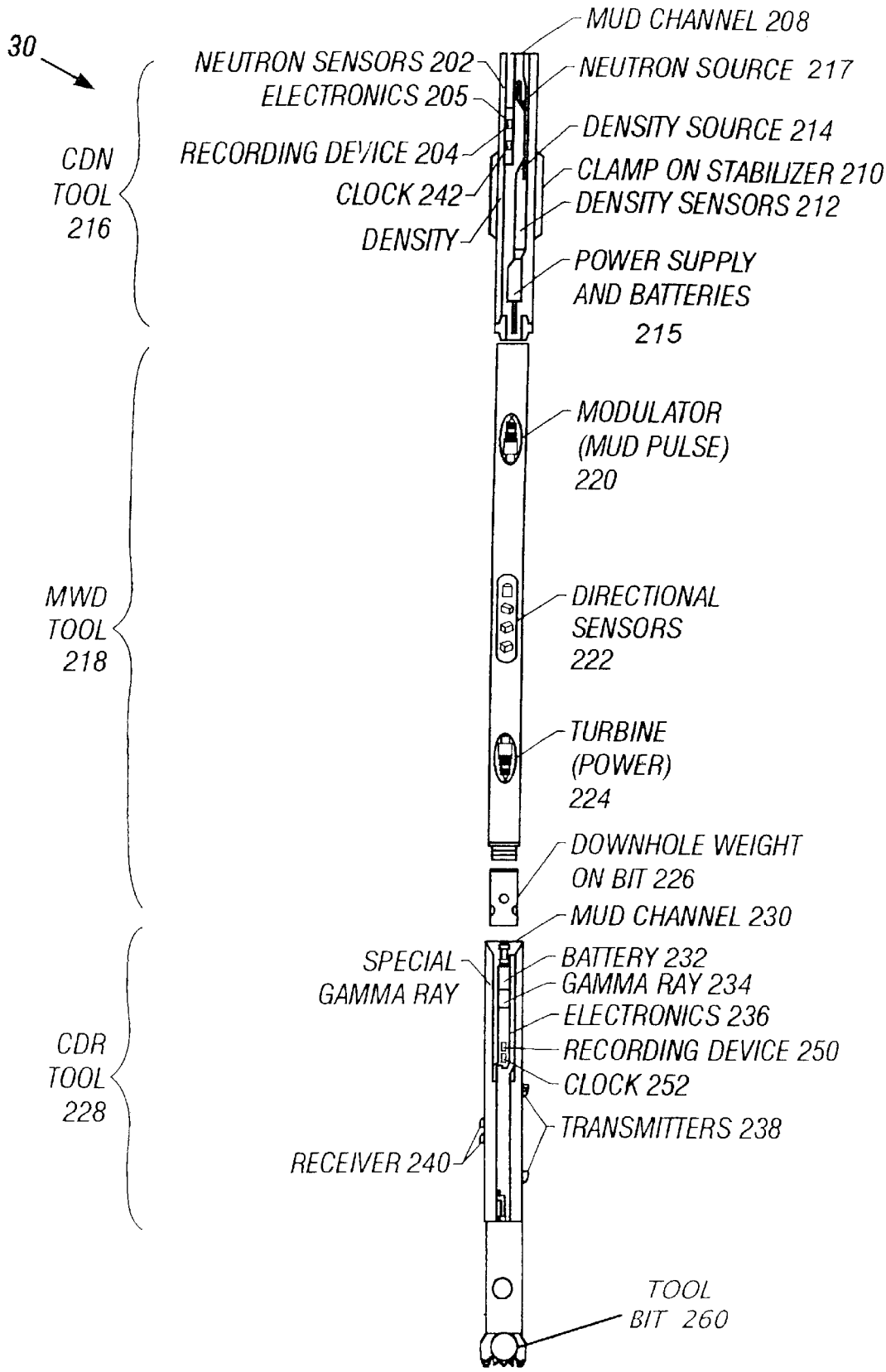
FIG. 2 illustrates a drilling bottom hole assembly (BHA) with several tools appropriate for embodiments of the present invention.

Referring to FIG. 2, a more specific view of the tool 30 is shown. The tool includes equipment according to an embodiment of the present invention appropriate for logging while drilling (LWD) and measurement while drilling (MWD), as design requirements may dictate. As shown, tool 30 includes three portions, each of which may be included or excluded from the tool 30, as measurement system requirements require. A tool 30 may include a compensated dual resistivity tool (CDR) or other type of resistivity tool 216, a measurement-while-drilling (MWD) tool 218, a compensated density neutron (CDN) tool 228, as well as other known specific measurement type tools. Each of the CDR, MWD and CDN type tools, as chosen are coupled together to form tool 30. Specifically, a CDN tool 216 includes neutron sensors 202, a neutron source 217, a density source 214, clamp on stabilizers 210, density sensors 212 and power supply and batteries 215. The CDN tool 216 further provides a mud channel 208 that allows mud to flow through the tool 216. CDN tool 216 further includes electronics 205, which may include a recording device and a clock.

The CDN tool can be coupled above an MWD tool 218. MWD tool 218 includes a modulator 220 for transmitting via the mud channel 208, directional sensors 222 configured to triangulate the location of tool 30 and a turbine 224 configured to provide power to the tool 30. MWD tool 218 further includes a downhole weight for a bit 226, which includes torque sensors. The MWD tool 218 may be coupled to a CDR tool 228. CDR tool 228 is shown including a mud channel 230 that flows through the tool 30, battery 232, gamma ray equipment 234, electronics 236, transmitters 238 and receivers 240. As one of skill in the art appreciates, the number of transmitters and receivers is according to design requirements. Electronics 236 includes a recording device 250 coupled to a clock 252. CDR tool 228 or the MWD tool 218, determined according to the configuration chosen for the tool 30, are coupled to a motor and a drill bit 260 configured to drill in the drill hole environment 36.

LWD tools, which include CDN tool 216, CDR tool 228 and MWD tool 218 provide measurements that indicate a hole trajectory and provide drilling mechanics measurements in real time. LWD measurements provide resistivity, neutron, density and gamma ray measurements, among other measurements in real time. Thus, MWD and LWD type measurements minimize drilling costs by providing measurements during a drilling procedure. A further benefit of LWD and MWD is that the measurements stored in recording devices 204 and 250, may be combined with wireline logs for a complete evaluation of the formation 36.

The LWD and MWD tools within tool 30, according to an embodiment of the present invention, are equipped to provide a system and method for identifying variations of a formation after an event. LWD and MWD tools include sensors, such as transmitter 238 and receiver 240 that measure different characteristics of the formation. In practice, the drilling of an oil or gas well requires repeated movement the sensors of the tool 30 over a same area. For example, when tool bit 260 requires replacement, the tool 30 is removed from the well and replaced. Further, during the course of drilling a well, the drill bit and drillstring will be "reciprocated" within the borehole (moving it up and down) to assist in cleaning the hole (ensuring the cuttings are circulated to surface) and general hole conditioning. Thus, during the drilling of an oil or gas well, tool 30 retracts repeatedly during the course of drilling and measuring a formation.

In an embodiment, tool 30 is configured to take advantage of the repeated retracting and insertion of the tool 30. More particularly, in the embodiment, a clock, such as clock 252 within tool 30, or clock 34 outside the tool 30, is synchronized with a depth measurement of the tool 30 to operate measurement tools within tool 30 that log measurements of resistivity, gamma ray, density, neutron porosities, calipers and photoelectric effect. According to the embodiment, the tool 30 repeatedly correlates one or more predetermined depths or zones of interest with a time parameter and associates the correlated time/depth measurement with the qualitative log measurements.

Figure 3:
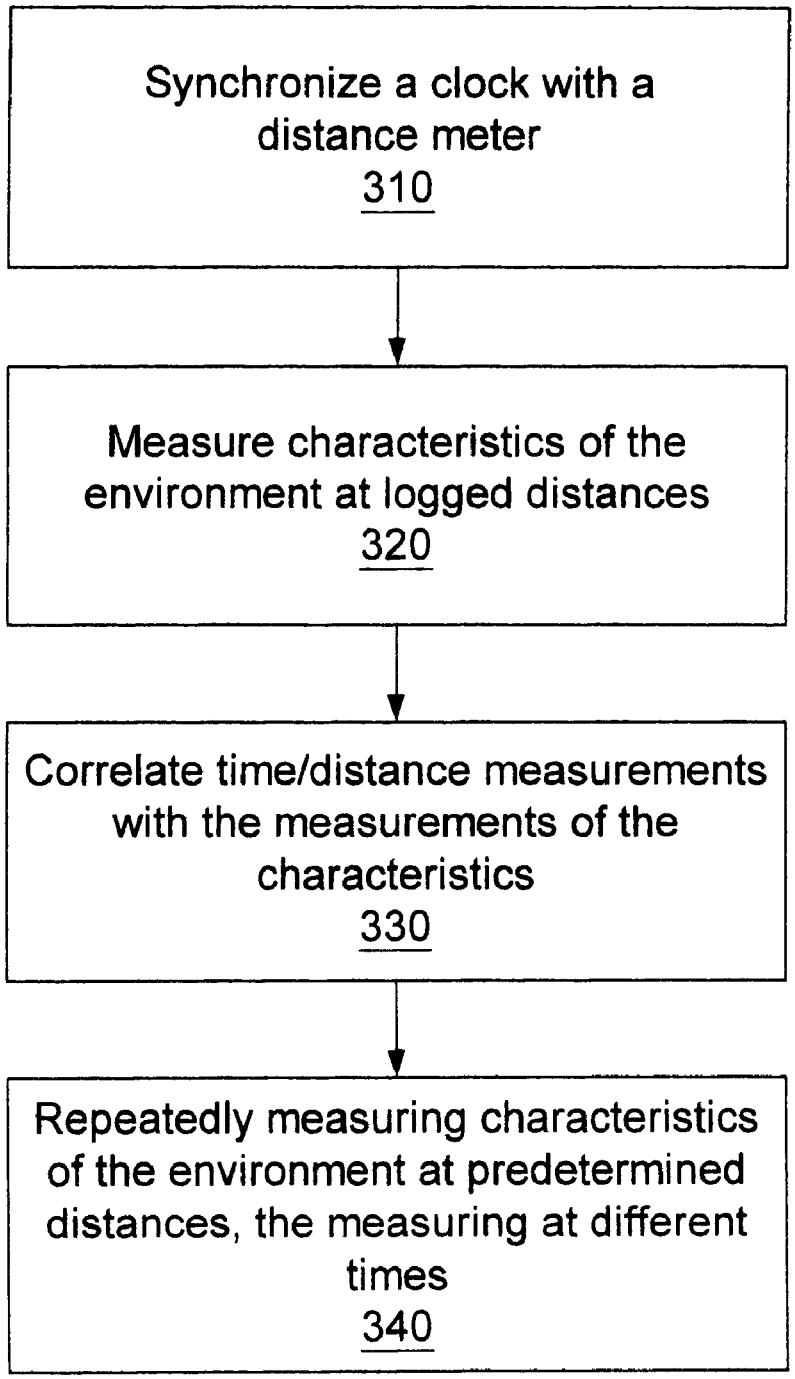
FIG. 3 is a flow diagram illustrating a method according to an embodiment of the present invention.

Referring now to FIG. 3, a flow diagram illustrates a method according to the embodiment. As shown, block 310 provides for synchronizing a clock with a distance measurement. For example, a clock can by synchronized with a distance measurement to provide a log of depths at particular positions. Block 320 provides for measuring characteristics of the environment at the logged distances, such as logged depths of an oil well. The measurements can include quantitative log measurements of resistivity, gamma ray, density, neutron porosities, calipers and photoelectric effect for drilling environments. The measurements are those appropriate for the environment under investigation and other environments are within the scope of the embodiment. For example, any environment wherein correlating a distance, time and measurement provides helpful data for determining characteristics of the environment would be an appropriate environment. Block 330 provides for correlating the time/depth measurement with the measurements of the environment. Thus, for each time/depth measurement, a measurement of the environment can be correlated thereto.

In some embodiments, one or more measurement tools may be located approximately 50 feet behind the tool bit 260. Thus, an offset may be applied to any depth measurement associated with the depth sensor near tool bit 260. To associate the measurements taken with a depth, techniques referred to as "time after bit" determine a time that has elapsed between the bit first penetrating a formation and a log being recorded in relation to that time.

An embodiment of the present invention advantageously incorporates the techniques of "time after bit." Specifically, referring to FIG. 2, a clock 252 or a clock at the surface, such as clock 34 shown in FIG. 1, assists in determining when tool 30 passes into a predetermined depth so that when sensors enter a zone of interest, the clock and the measurement tools can be more accurately synchronized to measure the formation. In one embodiment, although the tool acquires data continuously, measurements of interest can be highlighted automatically for predetermined depths, or an operator can operate the tool to take measurements or highlight measurements among a plurality of measurements for certain depths. For example, when tool 30 passes a deeper depth, enters an uninteresting depth, or leaves the zone of interest, the data acquired can be automatically or manually filtered. Unlike prior art measurement techniques the techniques and apparatus described herein allow the use of the measurements from tool 30 that operate to measure the formation dynamically. Tool 30 can repeatedly and continuously measure the zone of interest/depth over a period of hours, days or weeks, and the embodiments herein allow the data taken to be used effectively.

During drilling, tool 30 requires retraction and re-insertion into the formation, such as, for example, each time tool bit 260 requires changing. Clock 34/252 in combination with synchronized measurement tools dynamically measure the zone of interest, or predetermined depths. Time after bit techniques assure that the measures from the measurement tools can be used more effectively to determine additional characteristics which are not determinable from a single measurement.

Referring back to FIG. 3, block 340 provides for repeatedly measuring characteristics of the environment at predetermined distances, the measuring at different times. Specifically, the clock and the measurement tool(s) can be configured such that the measurement tools repeatedly measure the predetermined distances, and specific processing can be chosen to look at the data that was acquired at the depth or depths of interest. In one embodiment, the tool records and acquires data continuously, and repeatedly measures characteristics of the environment at the predetermined depth each time the depth meter nears the predetermined depth, such as within a zone of interest.

Figure 4:
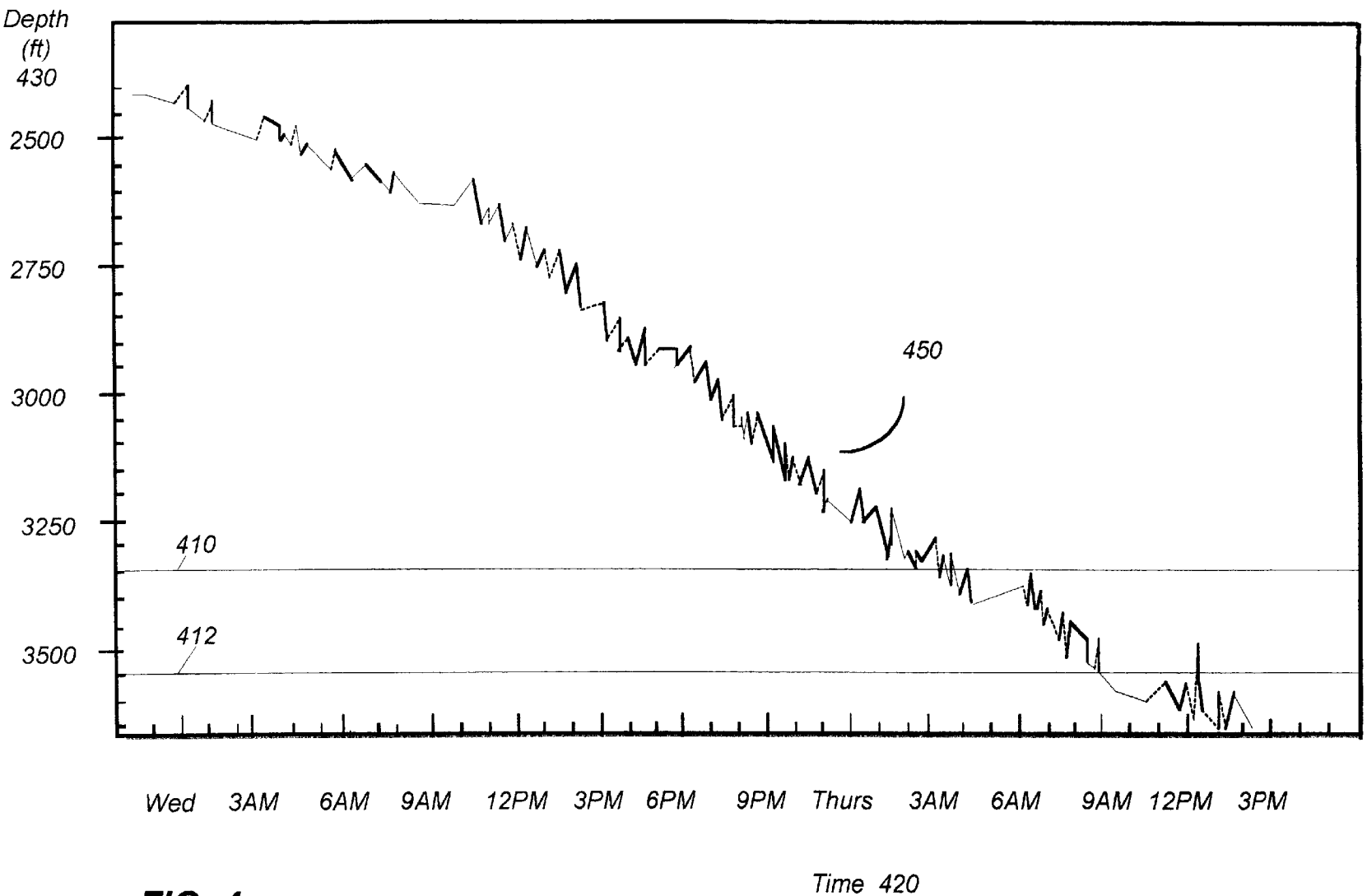
FIG. 4 is a graph illustrates an example of a time/depth profile in accordance with an embodiment of the present invention.

Referring now to FIG. 4, a graph illustrates an example of time/depth profiles in accordance with the method shown in FIG. 3. As shown, time values are shown along axis 420 and depth values are shown along axis 430. As a tool increases in depth, the values increase along axis 430. At all depths, the bit passes more than once. The depths shown may refer to a bit depth or a sensor depth, depending on the processing of data from the tool 30.

Figure 5:
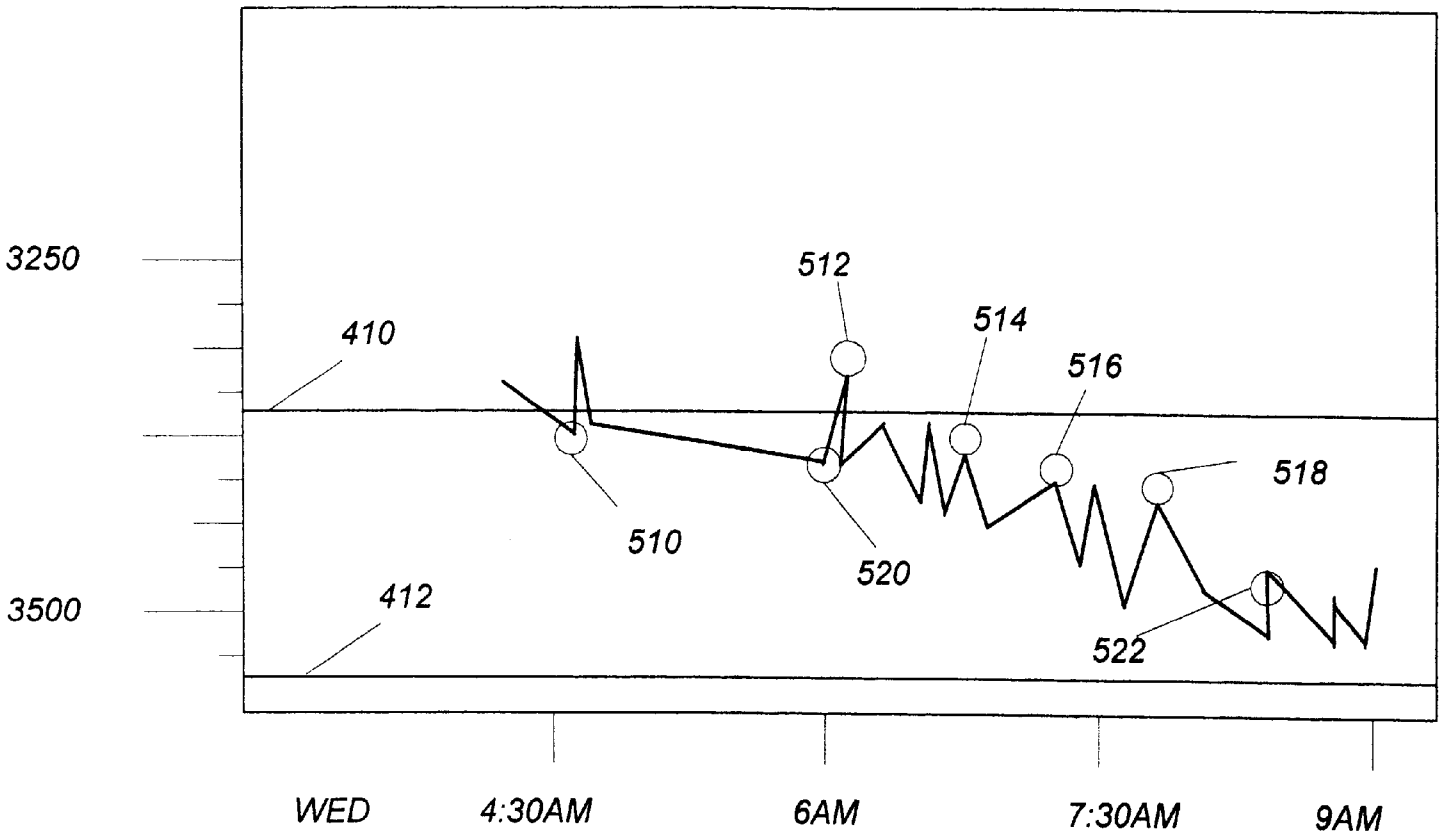
FIG. 5 is a graph of a portion of a time/depth profile graph indicating a zone of time and depth of interest in accordance with an embodiment of the present invention.

As shown in FIG. 4, the graph indicates that the tool 30 made several passes near 3400 feet of depth in the well as shown by the zone between lines 410 and 412. Referring to FIG. 5, the portion of graph of FIG. 4 within lines 410 and 412 is shown more particularly, indicating a zone of time and depth of interest near 3400 feet. The logging measurements taken are shown on FIG. 5 as points 510, 512, 514, 516, 518, 520 and 522. Not all of points 510–522 are within the zone outlined by lines 410 and 412. Although the measurements are near a predetermined depth, in a typical drilling scenario the actual measurements may be at or near the predetermined depth and can be both above and below the predetermined depth. On average over a period of time, however, the measurements are close to the predetermined depth. In one embodiment, the logging tools log measurements for a complete formation and later processing analyzes a zone of time and/or depth of interest, such as near 3400 feet.

Tool 30 continues to acquire data as tool 30 enters the zone of interest between lines 410 and 412, as can be indicated on a depth measurement log. Logging tools within tool 30 take measurements 510–522. One embodiment is directed to tools for which a depth measurement is determined by taking into account the distance from the tool bit and the logging tools taking measurements. In the embodiment, the logging tools or a processor within or without the logging tools are configured to subtract the difference that accounts for the distance between the bit and the logging tools from the actual depth at or near the tool bit. The configuration can implement "time after bit" techniques or other appropriate techniques for accounting for the distance between tool bit and the logging tools. In some one or more embodiments, a time after bit plot can depend on a drilling rate and a related distance between bit and logging sensors.

For example, assume that a processor records the depths of tool bit 260 and logging tools are 50 feet behind tool bit 260. Referring to FIG. 4, when the tool bit passes a point near 3300 feet, the logging tools are 50 feet behind the tool bit at 3250. According to an embodiment, the measurements taken from logging at 3250 feet are adjusted according to the location of the tool bit. Logging data for a zone of interest is completely acquired after the tool bit reaches a depth 50 feet outside of a zone of interest, for example, 3600 feet.

Figure 6:
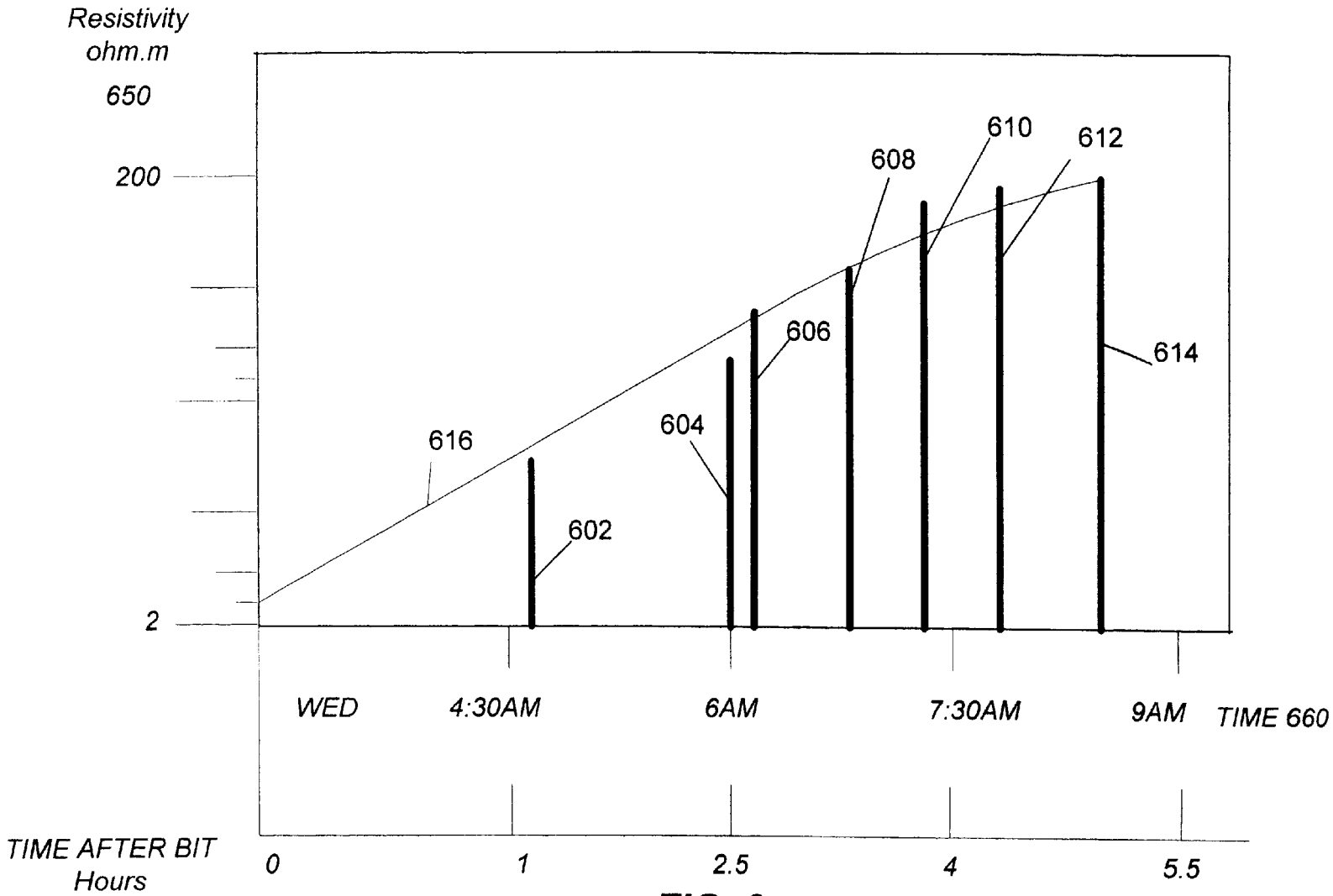
FIG. 6 is a graph showing measurements taken at a plurality of measurement points in accordance with an embodiment of the present invention.

Referring now to FIG. 6, a graph shows resistivity measurements 602, 604, 606, 608, 610, 612 and 614 on a logarithmic scale in Ohm-meters 650. FIG. 6 also shows a time axis 660, the time axis matching the time axis shown in FIG. 5.

As shown in FIG. 6, the resistivity measurements show a change in resistivity as time progressed between 4:30 AM and 9 AM. The resistivity measurements can be fit to a curve, as shown with curve 618 to more clearly show changes in resistivity over time. Although resistivity is shown in FIG. 6, one of skill in the art with the benefit of this disclosure appreciates that other types of characteristics of a formation are appropriate for the invention. For example, tool 30 includes tools capable of measuring characteristics of resistivity, gamma ray, density, neutron porosities, calipers and photoelectric effect. In an embodiment, not only the characteristics of the formation are taken into account, but additional variables are accounted for over time. For example the pressure of the drill, mud weight and other variables related to the mud, pump pressure, flow rate, rotational speed of the drill string, the type of bit used at different times, and the type of bottom hole assembly (BHA) may also be accounted for in a graph.

Referring back to FIG. 6, the resistivity increased linearly over time, indicating that a change in the formation at the predetermined depth likely occurred as a result of the drilling procedures. According to an embodiment of the present invention, the graph shown in FIG. 6 assists in determining whether and how a drilling procedure changes a formation under investigation. For example, rock formations, such as substantially shale formations typically have a low resistivity response. In this example, upon a fracture caused by a drilling procedure, an increase in resistivity typically occurs. Further, a change to a lower resistivity occurs upon the fracture closing. Thus, according to an embodiment, a time vs. resistivity graph provides an indication of when a fracture occurred and whether or not the fracture closed.

One embodiment of the invention is directed to providing a quantitative analysis of a formation showing effects from formation-changing events. For example, a formation subjected to drilling can experience changes that inhibit drilling procedures. One type of change is commonly caused by the invasion of the mud into the formation. There is also a plurality of other drilling-induced changes. The invasion of the mud can cause obfuscation in many cases and, in worse cases, obliteration of pre-drilling characteristics of the formation.

One pre-drilling characteristic is referred to as the true resistivity (RT) of the formation, and is helpful in determining the quality of the formation for drilling purposes. More particularly, the RT of a formation provides useful data concerning the likelihood of locating mineral deposits. One technique for determining the RT of a formation includes measuring the shallow, medium and deep areas surrounding the drill string, and subtracting the medium and/or the shallow measurements from the deep measurements to determine the RT measurements to acquire measurements of the other area(s). One of skill in the art appreciates that the actual technique is more computationally difficult than a subtraction, and that the use of the term subtracting is intended for exemplary purposes only.

Along with RT, a quantitative analysis can provide useful data for difficult formations being drilling. For example, one type of difficult formation includes tertiary undercompacted shale, wherein mud hydrostatic pressure and formation pore pressure must be balanced or a blowout is possible. Determining the effect of formation-changing events can identify a formation as requiring balancing to prevent over-pressure from mud weight or other parameters.

Figure 7:
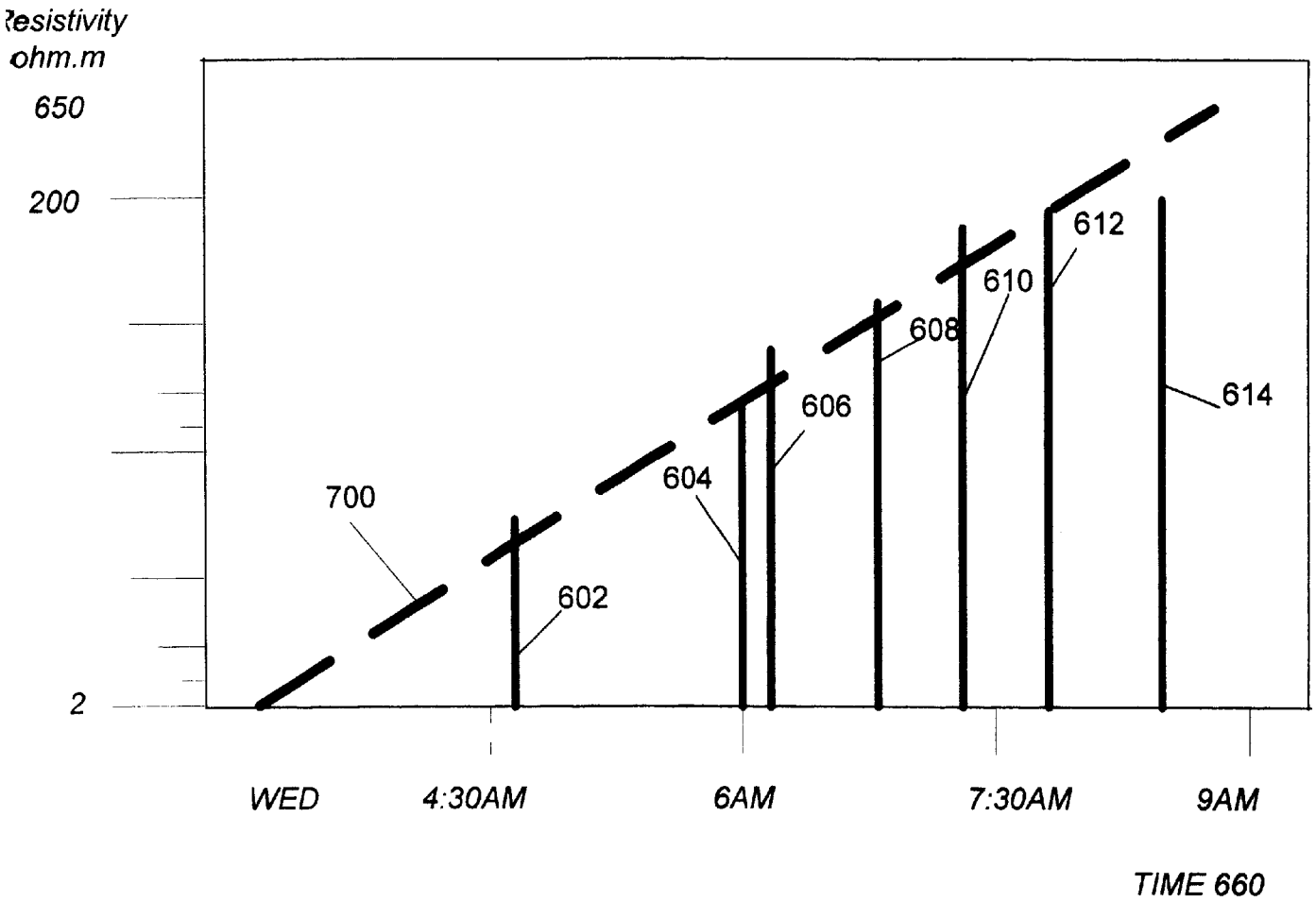
FIG. 7 is a graph illustrating an extrapolation of a linear resistivity curve to a pre-drilling time period.

Referring now to FIG. 7, a graph shows an extrapolation of a linear resistivity curve to a pre-drilling time period. According to an embodiment, FIG. 7 illustrates a technique for determining RT without relying on manipulations of measurements such as those described above. More particularly, FIG. 7 shows a line 700 that follows the resistivity measurements, showing a linear pattern for the predetermined depths under study in FIG. 7. The curve 700, in one embodiment, includes an extrapolation of the resistivity measurements to pre-drilling time periods. Specifically, the portion shown prior to resistivity measurement 602 is an extrapolation, continuing the curve formed by tracing the resistivity measurements. As will be appreciated by one of skill in the art, the curve can be a point-to-point curve, an average of a plurality of measurement points or the like.

The curve 700 can be helpful to operators of a drill string by predicting resistivity changes in the future due to invasion of the mud into the formation that can obfuscate the pre-drilling characteristics of the formation. Further, analysis of a time-based measurement, such as downhole pressure or mud weight with respect to the resistivity at a certain depth, can in some instances indicate a step jump once the pressure/mud weight rises above a certain amount. Such a step jump would indicate a certain fracture or collapse pressure of the formation that would not otherwise be evident.

Figure 8:
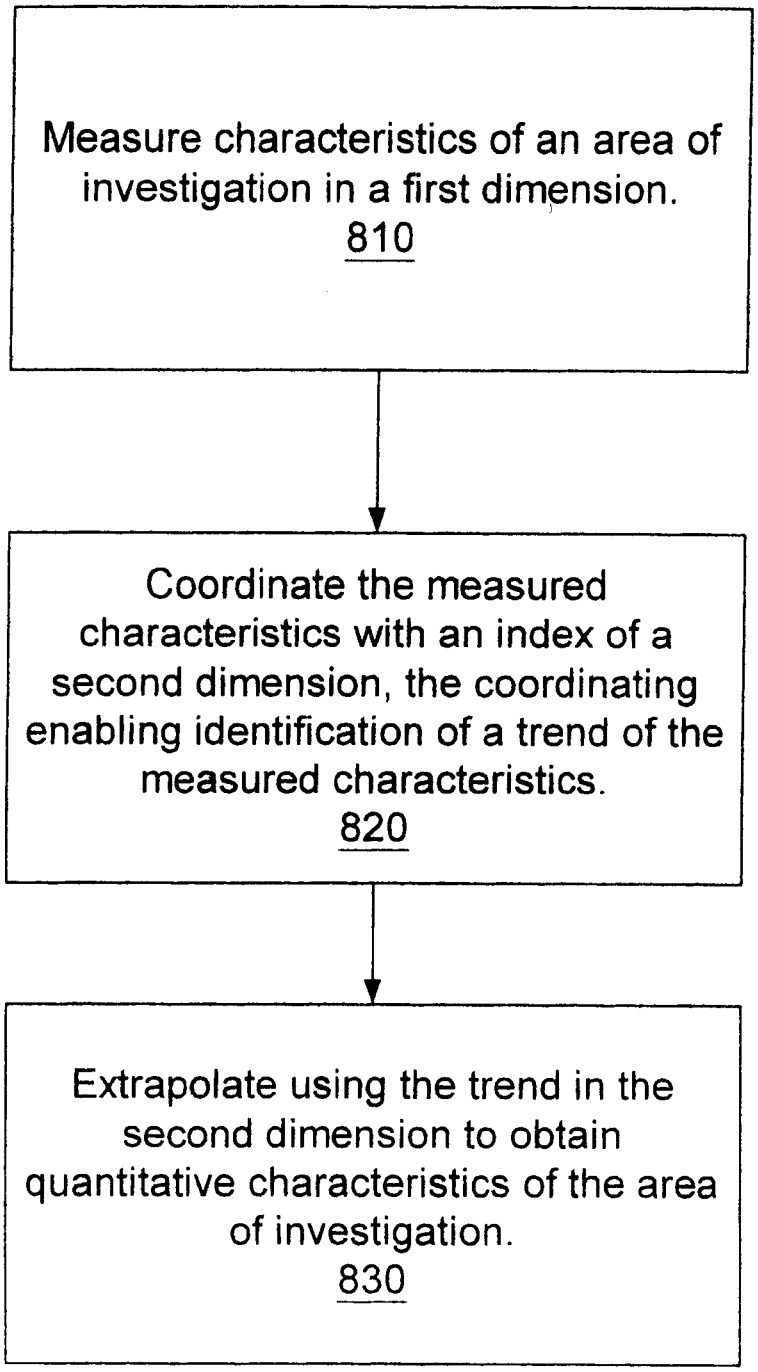
FIG. 8 is a flow diagram illustrating a method according to an embodiment of the present invention.

Referring now to FIG. 8, a flow diagram illustrates a method according to an embodiment for obtaining quantitative characteristics of an area of investigation. Block 810 provides for measuring characteristics of the area of investigation in a first dimension. A first dimension may include a depth dimension. For example, a measuring tool may record resistivity of an area of investigation at different depths. Block 820 provides for coordinating the measured characteristics with an index of a second dimension, the coordinating enabling identification of a trend of the measured characteristics. The second dimension may include a time dimension provided by a clock synchronized with a depth meter. The graphs discussed above provide examples of coordinating measured characteristics in a depth dimension with a time dimension. The trend of the measured characteristics can be found by using the measured characteristics, e.g., resistivity, and plotting them against the second dimension. Block 830 provides for extrapolating using the trend in the second dimension to obtain quantitative characteristics of the area of investigation. As shown in FIG. 7, the trend in the second dimension of time is illustrated by the line following the measured resistivities over time. In one embodiment, the method includes identifying a curve that is stable enough to identify a trend over time, as shown by block 840. Known statistical methods may be applied to the measured characteristics to extrapolate a curve.

Figure 9:
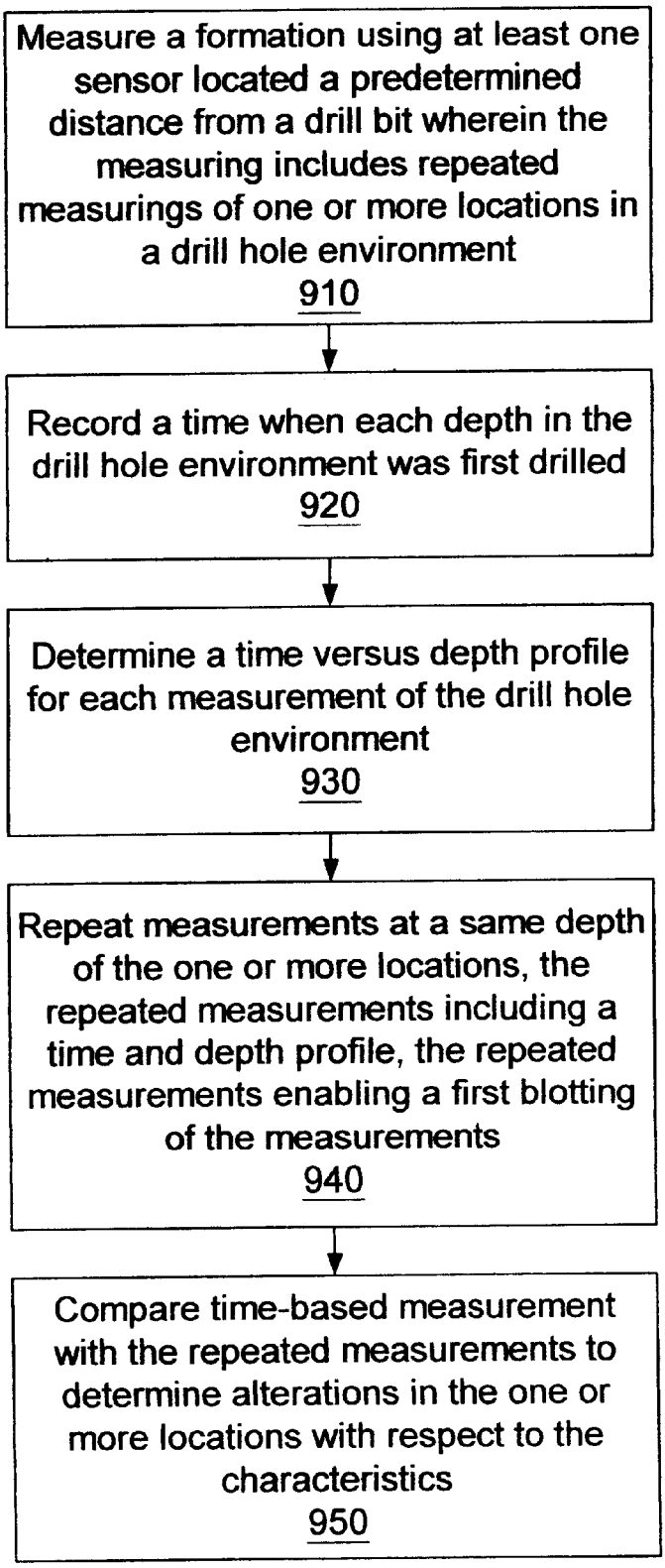
FIG. 9 is a flow diagram illustrating a more particular embodiment of a method of the present invention.

Referring now to FIG. 9, a flow diagram illustrates a more specific application of the method described in FIG. 8. As shown, FIG. 9 provides a method for quantifying time lapse measurements of characteristics in a drill hole environment. Block 910 provides for measuring a formation using at least one sensor located a predetermined distance from a drill bit wherein the measuring including repeated measuring of one or more locations in the drill hole environment. The sensor can be a depth meter located at or near a drill bit, the method employing time-after-bit techniques to coordinate the measurements with a time component. Block 920 provides for recording a time when each depth in the drill hole environment was first drilled. Block 930 provides for determining a time versus depth profile for each measurement of the drill hole environment. Block 940 provides for repeating measurements at a same depth of the one or more locations, the repeated measurements including a time and depth profile, the repeated measurements enabling a first plotting of the measurements. Block 950 provides for comparing time based measurement with the repeated measurements to determine alterations in the one or more locations with respect to the characteristics.

Figure 10:
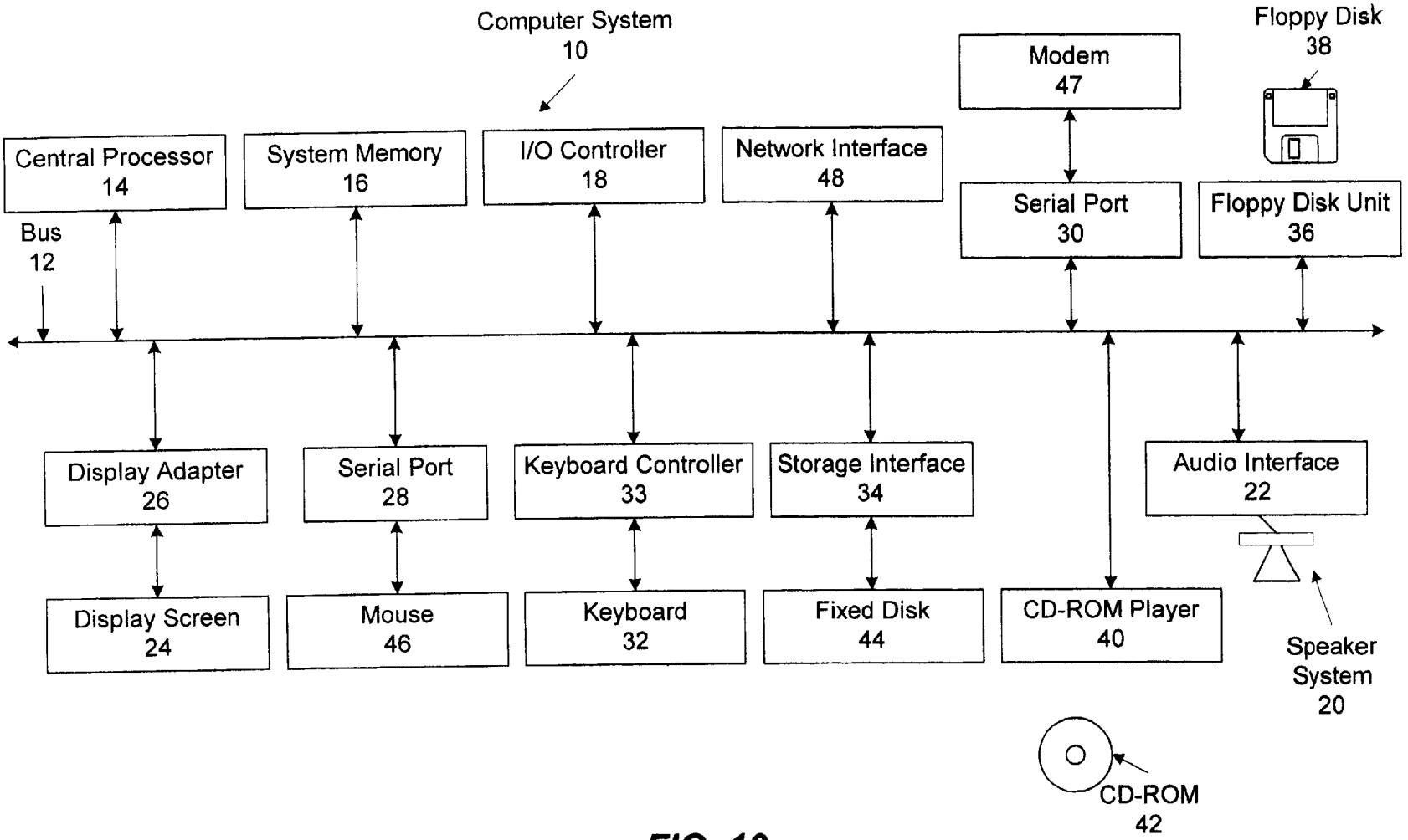
FIG. 10 is a computer system appropriate for implementing one or more embodiments of the present invention.

FIG. 10 depicts a block diagram of a computer system 10 suitable for implementing software and computer system embodiments of the present invention. Computer system 10 includes a bus 12 which interconnects major subsystems of computer system 10 such as a central processor 14, a system memory 16 (typically RAM, but which may also include ROM, flash RAM, or the like), an input/output controller 18, an external audio device such as a speaker system 20 via an audio output interface 22, an external device such as a display screen 24 via display adapter 26, serial ports 28 and 30, a keyboard 32 (interfaced with a keyboard controller 33), a storage interface 34, a floppy disk unit 36 operative to receive a floppy disk 38, and a CD-ROM player 40 operative to receive a CD-ROM 42. Also included are a mouse 46 (or other point-and-click device, coupled to bus 12 via serial port 28), a modem 47 (coupled to bus 12 via serial port 30) and a network interface 48 (coupled directly to bus 12).

Bus 12 allows data communication between central processor 14 and system memory 16, which may include both read only memory (ROM) or flash memory (neither shown), and random access memory (RAM) (not shown), as previously noted. The RAM is generally the main memory into which the operating system and application programs are loaded and typically affords at least 16 megabytes of memory space. The ROM or flash memory may contain, among other code, the Basic Input-Output system (BIOS) which controls basic hardware operation such as the interaction with peripheral components. Application programs resident with computer system 10 are generally stored on and accessed via a computer readable medium, such as a hard disk drive (e.g., fixed disk 44), an optical drive (e.g., CD-ROM player 40), floppy disk unit 36 or other storage medium. Additionally, application programs may be in the form of electronic signals modulated in accordance with the application and data communication technology when accessed via network modem 47 or interface 48.

Storage interface 34, as with the other storage interfaces of computer system 10, may connect to a standard computer readable medium for storage and/or retrieval of information, such as a fixed disk drive 44. Fixed disk drive 44 may be a part of computer system 10 or may be separate and accessed through other interface systems. Many other devices can be connected such as a mouse 46 connected to bus 12 via serial port 28, a modem 47 connected to bus 12 via serial port 30 and a network interface 48 connected directly to bus 12.

Although the examples herein are described with computer 10 in a stand-alone environment, computer 10 can be linked to a network. Modem 47 may provide a direct network connection to a remote server via a telephone link or to the Internet via an internet service provider (ISP). Network interface 48 may provide a direct connection to a remote server via a direct network link such as a direct link to the Internet via a POP (point of presence). Network interface 48 may provide such connection using wireless techniques, including digital cellular telephone connection, Cellular Digital Packet Data (CDPD) connection, digital satellite data connection or the like.

When computer 10 connects to the Internet, computer 10 is able to access information on one or more of servers (not shown) using, for example, a web browser (not shown). An example of the type of information accessed includes the pages of a web site hosted on one of the servers. Protocols for exchanging data via the Internet are well known to those skilled in the art. While the Internet can be used by computer 10 for exchanging data, the present invention is not limited to the Internet or to any network-based environment and, as described above, may operate in a stand-alone environment.

The web browser running on computer 10 can employ a TCP/IP connection to pass a request to one of the network servers, which can run an HTTP "service" (e.g., under the WINDOWS® operating system) or a "daemon" (e.g., under the UNIX® operating system), for example. Such a request can be processed, for example, by contacting an HTTP server employing a protocol that can be used to communicate between the HTTP server and the given client computer. The HTTP server then responds to the request, typically by sending a web page formatted as an HTML file. The web browser interprets the HTML file and may form a visual representation of the HTML file using local resources of the given client computer system, such as locally available fonts and colors.

Many other devices or subsystems (not shown) may be connected in a similar manner (e.g., bar code readers, document scanners, digital cameras and so on). Conversely, it is not necessary for all of the devices shown in FIG. 10 to be present to practice the present invention. The devices and subsystems may be interconnected in different ways from that shown in FIG. 10. The operation of a computer system such as that shown in FIG. 10 is readily known in the art and is not discussed in detail in this application. Code to implement the present invention may be stored in computer-readable storage media such as one or more of system memory 16, fixed disk 44, CD-ROM 42, or floppy disk 38. Additionally, computer system 10 may be any kind of computing device, and so includes a personal data assistants (PDA), network appliance, X-window terminal or other such computing device. The operating system provided on computer system 10 may be MS-DOS®, MS-WINDOWS®, OS/2®, UNIX®, Linux® or another known operating system. Computer system 10 also supports a number of Internet access tools, including, for example, an HTTP-compliant web browser having a JavaScript interpreter, such as Netscape Navigator®, Microsoft Explorer® and the like.

Moreover, regarding the signals described herein, those skilled in the art will recognize that a signal may be directly transmitted from a first block to a second block, or a signal may be modified (e.g., amplified, attenuated, delayed, latched, buffered, inverted, filtered or otherwise modified) between the blocks. Although the signals of the above-described embodiment are characterized as transmitted from one block to the next, other embodiments of the present invention may include modified signals in place of such directly transmitted signals as long as the informational and/or functional aspect of the signal is transmitted between blocks. To some extent, a signal input at a second block may be conceptualized as a second signal derived from a first signal output from a first block due to physical limitations of the circuitry involved (e.g., there will inevitably be some attenuation and delay). Therefore, as used herein, a second signal derived from a first signal includes the first signal or any modifications to the first signal, whether due to circuit limitations or due to passage through other circuit elements which do not change the informational and/or final functional aspect of the first signal.

Other Embodiments

Those skilled in the art will also appreciate that embodiments disclosed herein may be implemented as software program instructions capable of being distributed as one or more program products, in a variety of forms including computer program products, and that the present invention applies equally regardless of the particular type of program storage media or signal bearing media used to actually carry out the distribution. Examples of program storage media and signal bearing media include recordable type media such as floppy disks, CD-ROM, and magnetic tape transmission type media such as digital and analog communications links, as well as other media storage and distribution systems.

Additionally, the foregoing detailed description has set forth various embodiments of the present invention via the use of block diagrams, flowcharts, and/or examples. It will be understood by those skilled within the art that each block diagram component, flowchart step, and operations and/or components illustrated by the use of examples can be implemented, individually and/or collectively, by a wide range of hardware, software, firmware, or any combination thereof. The present invention may be implemented as those skilled in the art will recognize, in whole or in part, in standard Integrated Circuits, Application Specific Integrated Circuits (ASICs), as a computer program running on a general-purpose machine having appropriate hardware, such as one or more computers, as firmware, or as virtually any combination thereof and that designing the circuitry and/or writing the code for the software or firmware would be well within the skill of one of ordinary skill in the art, in view of this disclosure.

Although particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention.

What is claimed is:

1. A method for obtaining quantitative characteristics of an area of investigation, the method comprising:

measuring characteristics of the area of investigation in a first dimension wherein the first dimension is depth;

coordinating the measured characteristics with an index of a second dimension, the coordinating enabling identification of a trend of the measured characteristics, wherein the second dimension is time; and extrapolating using the trend in the second dimension to obtain quantitative characteristics of the area of investigation.

2. The method of claim 1 wherein:

the first dimension is a depth dimension, the measuring being a measuring of a zone of interest; and the area of investigation is a well, the zone of interest being a depth zone.

3. The method of claim 1 further comprising:

choosing one or more measurement points within the area of investigation; and plotting the one or more measurement points against the index of the second dimension to show changes of the characteristics of the area of investigation, the plotting providing quantifiable characteristics of the formation prior to the measuring.

4. The method of claim 1 wherein the characteristics include one or more measurements of resistivity, gamma ray, density, neutron porositics, magnetic resonance, temperature, calipers and photoelectric effect, drill pressure, mud weight, pump pressure, flow rate of mud, rotational speed, and characteristics of a bottom hole assembly.

5. The method of claim 1 wherein the coordinating includes associating measurements in the first dimension in a plot of depth and time of measurements.

6. The method of claim 5, wherein the plot of depth and time of measurements is a time after bit plot, wherein the plot depends on a drilling rate and a related distance between bit and logging sensors.

7. The method of claim 1 wherein the characteristics are measured using one or more of a logging-while-drilling and a measurement-while-drilling tool.

8. The method of claim 7 wherein the measurements of either or both of the logging-while-drilling and the measurement-while-drilling tool are combined with measurements taken by a wireline measurement tool.

9. A computer program product comprising:

a measurement object operable to direct measurements of characteristics of an area of investigation in a first dimension wherein the first dimension is depth;

a coordination object operable to coordinate the measured characteristics with an index of a second dimension, the coordination object enabling identification of a trend of the measured characteristics; and an extrapolation object operable to apply the trend in the second dimension to obtain quantitative characteristics of the area of investigation.

10. A method for quantifying time lapse measurements of characteristics in a drill hole environment, the method comprising:

measuring a formation using at least one sensor located a predetermined distance from a drill bit the measuring including repeated measuring of one or more locations in the drill hole environment;

recording a time when each depth in the drill hole environment was first drilled;

determining a time versus depth profile for each measurement of the drill hole environment;

repeating measurements at a same depth of the one or more locations, the repeated measurements including a time and depth profile, the repeated measurements enabling a first plotting of the measurements; and comparing time based measurement with the repeated measurements to determine alterations in the one or more locations with respect to the characteristics.

11. The method of claim 10 wherein the sensor is located a predetermined distance from the drill bit, the difference in time between drill bit first passing any one of the one or more locations and the sensor first passing any one of the one or more locations being taking into account to determine the time of the measuring of the one or more locations.

12. An apparatus configured for use in a drill hole environment, the apparatus comprising:

a clock configured to receive data from the depth meter; and a processor configured to correlate clock data and depth data to provide a time after bit measure associated with a plurality of measurements of the measurements taken by the tool whereby the measurements taken at different depths are useful as compared to measurements taken independent of the time after bit measurements.

13. The apparatus of claim 12 wherein the processor is configured to manipulate the measurements at the different depths against time to provide data concerning alterations to the drill hole environment over time.

14. The apparatus of claim 12 further comprising a depth meter at surface coupled to a tool in a drill string.

15. The apparatus of claim 12 wherein the tool includes at least one measurement tool configured to measure characteristics, which is placed in front of a depth repeatedly over time, a plotting of the measurements over time providing quantifiable data of changes to the drill hole environment during and after the drilling.

16. The apparatus of claim 15 wherein the alterations to the drill hole environment are due to one or more of drilling, production, mud effects and blowouts of the drill hole environment.

17. The apparatus of claim 15 wherein the quantifiable data enables an extrapolation back to a time when the drill hole environment was first drilled, the extrapolation providing data of the drill hole environment prior to the drilling.

18. The apparatus of claim 15 wherein the plot of the measurements over time providing quantifiable data is linearized by determining an equation for a line using statistical methods.

19. An apparatus to investigate characteristics in a drill hole environment, the apparatus comprising:

means for measuring a formation using at least one sensor located a predetermined distance from a drill bit, the measuring including repeated measuring of one or more locations in the drill hole environment;

means for recording a time when each depth in the drill hole environment was first drilled;

means for determining a time versus depth profile for each measurement of the drill hole environment;

means for repeating measurements at a same depth of the one or more locations, the repeated measurements including a time and depth profile, the repeated measurements enabling a first plotting of the measurements; and means for comparing time based measurement with the repeated measurements to determine alterations in the one or more locations with respect to the characteristics.

* * * * *